US005220951A

United States Patent [19]

Dagenais

[11] Patent Number: 5,220,951

[45] Date of Patent: Jun. 22, 1993

[54] HINGE CONSTRUCTION FOR A FOLDING CLOSURE ASSEMBLY

[76] Inventor: Robert Dagenais, 86 Grandcote, St-Eustache, Que. J7P 1A6, Canada

[21] Appl. No.: 784,329

[22] Filed: Oct. 31, 1991

[30] Foreign Application Priority Data

Oct. 24, 1991 [CA] Canada ..... 2054152

[51] Int. Cl.[5] ..... E05D 15/06

[52] U.S. Cl. ..... 160/199; 160/229.1; 160/235

[58] Field of Search ..... 160/229.1, 199, 206, 160/235

[56] References Cited

U.S. PATENT DOCUMENTS

| | | | |
|---|---|---|---|
| 29,308 | 7/1977 | Dagenais . | |
| 878,876 | 2/1908 | Fox . | |
| 1,426,969 | 8/1922 | Dunham . | |
| 1,463,346 | 7/1923 | Walker . | |
| 1,963,273 | 6/1934 | Kellogg . | |
| 2,699,827 | 1/1955 | Carson | 160/229.1 |
| 2,713,897 | 7/1955 | Teague et al. . | |
| 2,770,298 | 11/1956 | Hiatt . | |
| 2,954,081 | 9/1960 | Recchione . | |
| 3,053,318 | 9/1962 | Artman . | |
| 3,205,935 | 9/1965 | Cayton | 160/199 X |
| 3,267,990 | 8/1966 | Harris . | |
| 3,359,594 | 12/1967 | Pastoor . | |
| 3,419,063 | 12/1968 | Mock . | |
| 3,494,408 | 2/1970 | D'Ercole . | |
| 3,570,579 | 3/1971 | Matsushima | 160/206 X |
| 3,670,797 | 6/1972 | Sassano . | |
| 3,799,237 | 3/1976 | Proserpi . | |
| 3,972,365 | 8/1976 | Dixon . | |
| 4,081,881 | 4/1978 | Lamarre . | |
| 4,228,841 | 10/1980 | Dixon . | |
| 4,315,648 | 2/1982 | Labelle . | |
| 4,380,260 | 4/1983 | Labelle . | |
| 4,383,569 | 5/1983 | Labelle . | |
| 4,386,645 | 6/1983 | Dever et al. . | |
| 4,434,525 | 3/1984 | Labelle . | |
| 4,497,357 | 2/1985 | Labelle . | |
| 4,660,613 | 4/1987 | Dagenais . | |

FOREIGN PATENT DOCUMENTS 766561 9/1967 Canada .

*Primary Examiner*—Blair M. Johnson
*Attorney, Agent, or Firm*—Larson and Taylor

[57] ABSTRACT

A hinge construction for joining panels of a foldable closure assembly, comprising a female hinge member including an elongated substantially hollow channel which defines in cross-section an inner concave surface extending along an arc of circle and a fulcrum element in a spaced apart relationship with the concave surface. A male hinge member is received in the elongated channel for pivotal movement about the fulcrum element. The male hinge member includes an arcuate member defining in cross-section a convex surface extending along an arc of a circle and being in sliding contact with the concave surface, the male hinge member further including a supporting leg projecting from the arcuate member and engaging the fulcrum element in a supporting contact, the concave and convex surfaces being in an eccentric relationship whereby during a pivotal movement between the hinge members the surfaces contact each other in a sliding relationship over a zone smaller than the area of either one of the convex or the concave surfaces. The invention also extends to a foldable closure assembly comprising a novel hinge.

7 Claims, 4 Drawing Sheets

HINGE CONSTRUCTION FOR A FOLDING CLOSURE ASSEMBLY

FIELD OF THE INVENTION

The present invention relates to a hinge construction well suited for use in a folding closure or door having a series of vertical strip panels vertically hinged together and supported by rollers running in an overhead track. The invention also extends to a folding closure with an improved hinge for pivotally joining adjacent panels of the closure.

BACKGROUND OF THE INVENTION

Folding closure assemblies for closing and opening are well known. The folding assemblies may be solid panels, or alternatively, may be an open grill design. Such assemblies are used across store fronts in shopping malls and the like. When the closure is closed to fill the opening, the panels are substantially in line and flat, and when the closure is open, the panels are accordioned together and in some cases may fit into a compartment at one side of the opening. The use of the term "panels" throughout the specification refers to panels made of solid or one piece sheets, transparent sheets with supporting strips, or grills with apertures between supporting strips.

Folding closure assemblies are generally supported by rollers running in a track extending across the top of the opening. A bottom track is not generally used as it is preferred to have a smooth floor without obstructions in the opening, particularly for shopping malls.

There are many different designs of folding closure assemblies for store fronts and the like. Most of these designs are lightweight, generally made from aluminum, but strong enough to prevent access. Some have clear panels of glass or plastic therein, others are grill like which reduces the weight still further. Most of the designs have vertical hinges at the edges of each panel extending from the top to the bottom. The full length hinge tends to require some force to open and close due to friction, and the force to open one hinge must be multiplied by the number of hinges in the closure. Thus the overall force to open and close the assembly can be more than one individual can apply. Another disadvantage with some existing designs of folding closures is that they have many different components which increases the cost, makes the design complicated and the assembly heavy.

The U.S. Pat. No. 4,660,613 issued on Apr. 28, 1987 discloses an improved folding closure which overcomes many of the above-discussed problems by providing a novel hinge construction for pivotally joining adjacent panels of the closure, which is considerably easier to assemble. More particularly, the hinge construction includes an integral female hinge member with a pair of semi-circular grooves therein receiving curved side edges of the panels to be joined together. To assemble the hinge, it suffices to telescope the male hinge members in the female hinge member and to supply a screw for locking the components together and preventing accidental removal of the male hinge member from the female hinge member.

Although this form of hinge construction is superior to prior designs in terms of ease of assembly and operation, the manufacture of the female hinge member has been found to be complex and necessitating a comparatively high amount of raw material.

STATEMENT OF THE INVENTION

An object of the present invention is a novel hinge construction, well suited for use in folding closures or the like, which requires a comparatively low effort to be opened and closed, is lightweight and needs less raw material for its manufacture.

Another object of the invention is a folding closure assembly having an improved hinge for pivotally joining adjacent panels of the closure assembly, which is relatively lightweight and requires less force to be opened and closed.

As embodied and broadly described herein, the invention provides a hinge construction, comprising:

a female hinge member including an elongated substantially hollow channel which defines in cross-section an inner concave surface extending along an arc of a circle and a fulcrum element in a spaced apart relationship with said concave surface;

a male hinge member received in said elongated channel for pivotal movement about said fulcrum element, said male hinge member including an arcuate member defining in cross-section a convex surface extending along an arc of a circle and being in sliding contact with said concave surface, said male hinge member further including a supporting leg projecting from said arcuate member and engaging said fulcrum element in a supporting contact, said concave and convex surfaces being in an eccentric relationship whereby during a pivotal movement between said hinge members said surfaces contact each other in a sliding relationship over a zone smaller than the area of either one of said surfaces.

Surprisingly, it has been discovered that by reducing the sliding contact surface between the male and the female hinge members, a reduction in the effort required to operate a hinge is achieved. In addition, by providing a female hinge member of a hollow channel design the weight of the hinge is reduced and also the hinge is cheaper to manufacture because it requires less raw material.

In a preferred embodiment, the eccentric relationship between the concave and the convex surfaces of the female and the male hinge members respectively is achieved by forming the concave surface with a radius of curvature larger than the radius of curvature of the convex surface.

As embodied and broadly described herein, the invention further provides a foldable closure assembly comprising:

a plurality of panels;

a hinge joining a pair of adjacent panels of said plurality of panels, said hinge including:

a) an elongated female hinge member having a pair of generally parallel channels with respective longitudinal openings on opposing sides of said female hinge member, each channel defining an inner concave surface and a fulcrum member in a spaced apart relationship with said concave surface; and b) a pair of male hinge members received in respective channels of said female hinge member, each male hinge member having an arcuate portion and a supporting leg projecting from said arcuate portion engaging the concave surface and the fulcrum member respectively of the respective elongated channel, whereby pivotal movement between the female hinge and the male hinge member causes a sliding contact between the concave surface and the arcuate member while the supporting leg turns on the fulcrum member, said male hinge members being integrally formed on meeting side edges of said adjacent panels, thereby pivotally joining said panels to one another by the intermediary of said female hinge member.

By integrally forming the male hinge members with the panels of the folding closure assembly, and providing a female hinge member of a hollow channel design, the weight of the folding closure assembly is appreciatively reduced without significantly degrading the structural strength of the folding closure assembly.

In a preferred embodiment, cooperating abutments are provided on the male and the female hinge members to interrupt the pivotal movement of the panels immediately before they assume a coplanar relationship. As a result, when the folding closure assembly is in an extended condition, the panels lie at an angle of slightly less than 180° to one another. This ensures that upon collapsing the closure the panels will fold in an accordion-like fashion.

DESCRIPTION OF A PREFERRED EMBODIMENT

Figure 1:
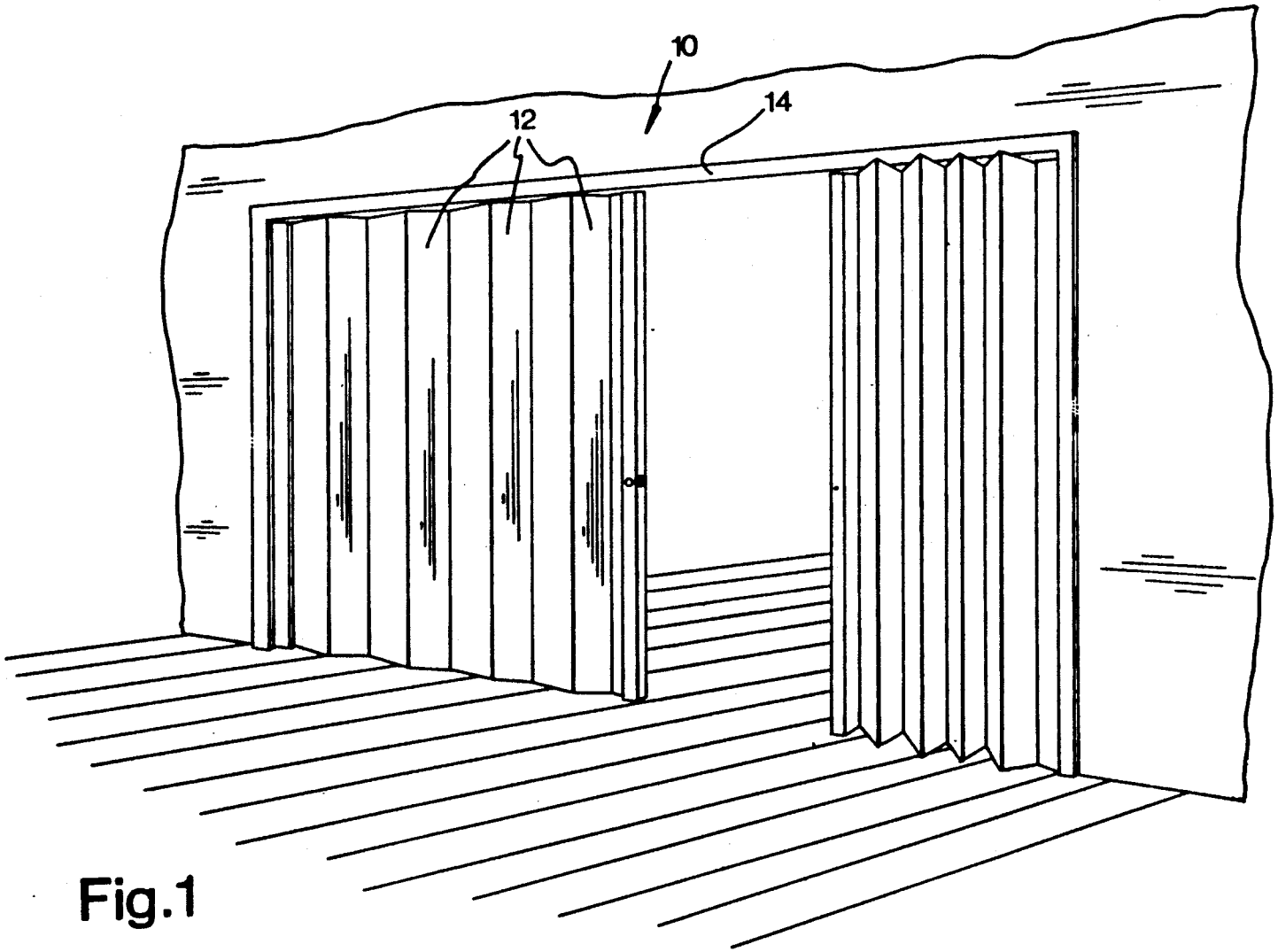
FIG. 1 is a perspective view of a folding closure assembly according to the invention.

Referring now to the annexed drawings, the reference numeral 10 designates a folding closure assembly including a plurality of panels 12 pivotally joined to one another in an accordion-like fashion and riding in an overhead track 14 by means of suitable rollers (not shown in the drawings) as it is customary in the art. The present invention provides a novel hinge, designated comprehensively by the reference numeral 16, for pivotally joining adjacent panels 12 of the folding closure assembly 10. The novel hinge construction is advantageous because it requires less raw material to manufacture, it is easier to produce by an extrusion process and also it is comparatively lightweight and easier to operate.

Figure 4:
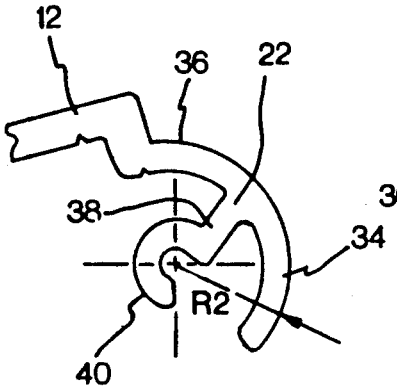
FIG. 4 is an elevational view of the male hinge member of the hinge shown in FIG. 3.
Figure 5:
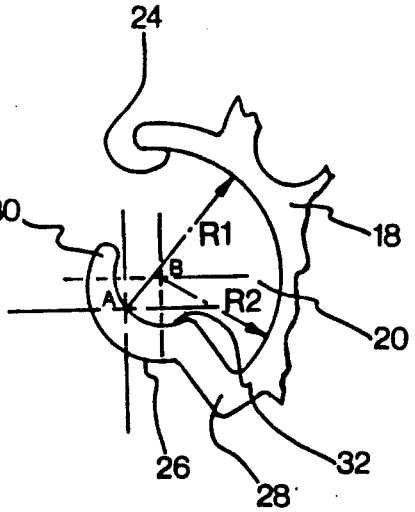
FIG. 5 is an elevational view of the female hinge member of the hinge shown in FIG. 3.

The hinge 16 comprises a female hinge member 18 which has a pair of hollow elongated channels 20 opening on opposite sides of the female hinge member 18. Each channel 20 receives therein in a pivoting relationship a male hinge member 22. The structure of the female and of the male hinge members is best shown in FIGS. 5 and 4 respectively.

The elongated channel of the female hinge member 18 has, in cross-section, an internal concave surface 24 which is shaped as a semi-circular surface having a radius of curvature R1. Opposite the concave surface 24 is formed a fulcrum member 26 including a strip-like portion 28 terminating with a hook-like member 30 provided with an elongated recess zone 32 directly facing the concave surface 24.

The male hinge member 22 is integrally formed along a vertical side edge of the panel 12 and comprises an arcuate member 34 having an outer convex surface 36 which in cross-section follows a semi-circular surface having a radius of curvature R2. From the arcuate member 34 projects a supporting leg 38 which terminates with a hook-like, rounded end 40.

The hinge 16 is assembled by telescoping the male hinge member 22 within the channel 20 of the female hinge member 18. In this condition, the convex surface 36 engages in sliding contact the concave surface 24 while the supporting leg 38 rests in the recess zone 32 of the fulcrum member 26. This relationship permits the male hinge member 22 to turn on the fulcrum member 26 while the convex surface 36 slides on the concave surface 24.

The convex surface 36 and the concave surface 24 are slightly eccentric to one another which is achieved by selecting radius R1 larger than radius R2 and by locating the centres of the imaginary circles corresponding to the surfaces 36 and 24 at different locations so that they do not coincide. This feature is best shown in FIG. 5. The centre of the circle corresponding to the concave surface 24 is located on the recessed area 32 and is designated by A. Point B corresponds to the centre of the circle of the convex surface 36. This relationship allows the semi-circular surfaces 36 and 24 of different radii to remain continuously in contact during the pivotal movement of the male hinge member 22 in the female hinge 18.

Figure 3:
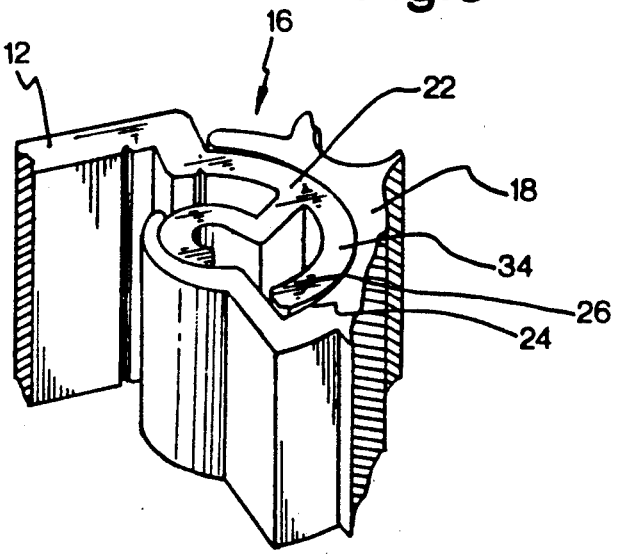
FIG. 3 is a fragmentary perspective view of a hinge for pivotally joining adjacent panels of the folding closure assembly shown in FIGS. 1 and 2.

As a result of the eccentric relationship between the concave surface 24 and the convex surface 26, the contact area between these surfaces is less than the area of either one of these surfaces. This characteristic is best shown in FIG. 3 where the extremities of the arcuate portion 34 are out of contact with the concave surface 24. It has been found that such a reduction in the contact area between the hinge members results into a reduction in the effort required to open and close the hinge 16. As a result, very large folding closure assemblies become easier to extend and collapse.

In a specific embodiment, R1 is 0.34 inches, R2 is 0.235 inches and the distance between points A and B is 0.085 inches.

Referring back to FIG. 2, the female hinge member 18 comprises an opening 40 which is used for receiving a self-tapping screw (not shown in the drawings) with an integral washer in order to prevent the male hinge members 22 from the sliding out of the female hinge member 18.

Figure 6:
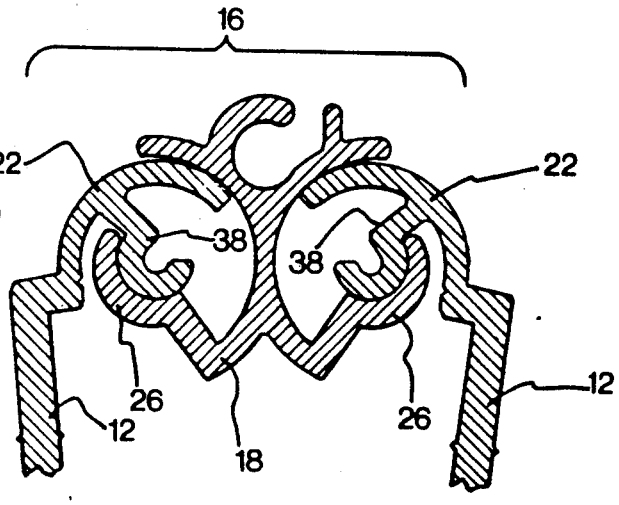
FIG. 6 is a cross-sectional view of a hinge member of the folding closure assembly according to the invention when the latter is in a collapsed condition.
Figure 7:
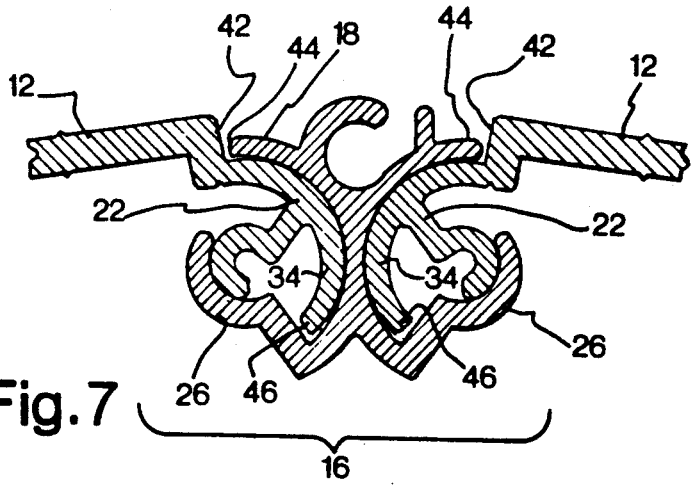
FIG. 7 is a view similar to FIG. 6, except that the folding closure assembly is in an extended condition.

As best shown in FIGS. 6 and 7, the hinge members 18 and 22 are provided with cooperating abutments in order to limit the pivotal motion of the panels 12 to approximately 90° for each panel. More particularly, the position of the fulcrum members 26 and the supporting leg 38 are selected so that they abut against each other to prevent any further pivotal movement at the hinge 16 when the foldable closure assembly is fully collapsed and the panels 12 are generally parallel to one another.

When the folding closure assembly is fully extended, as shown in FIG. 7, cooperating abutments on the hinge members interrupt the panel pivoting movement immediately before the panels become coplanar. As a result, when the folding closure assembly is collapsed, this arrangement ensures that the panels will fold into an accordion-like fashion. The abutments that prevent the panels from becoming coplanar include shoulders 42 at the junction between the male hinge members 22 and the respective panels 12, and edges 44 of the female hinge member 18, and edges 46 of the arcuate members 34 and the base of the fulcrum elements 26.

Figure 2:
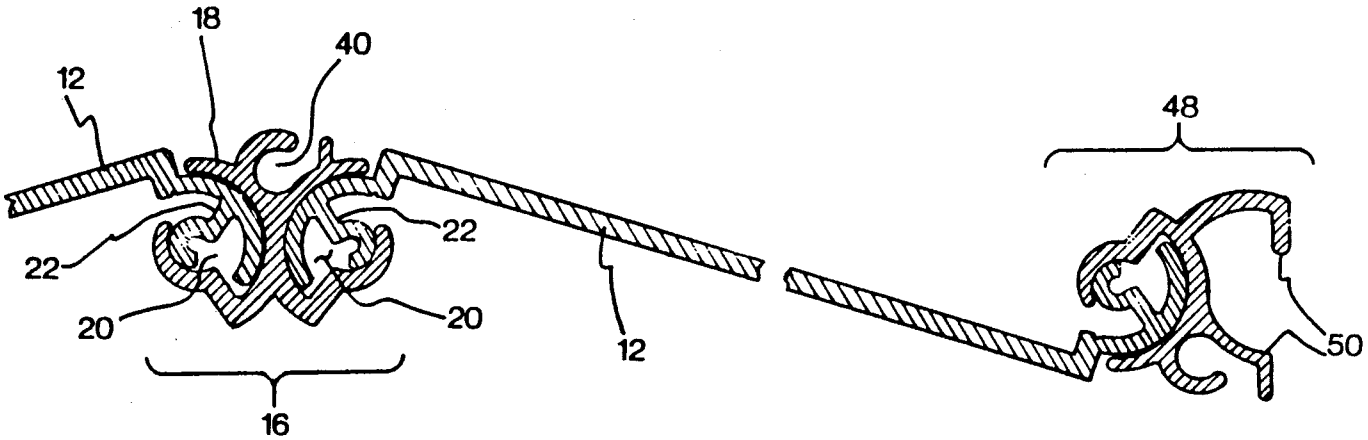
FIG. 2 is an enlarged horizontal cross-sectional view of the folding closure assembly shown in FIG. 1.

In a variant shown in FIG. 2, a modified form of construction of the hinge 16 is illustrated at 48. The hinge 48 is designed for use with a single male hinge member and is provided with connector legs 50 which are designed to provide a non-pivotal connection either to a stationary member such as an upright to which the folding closure assembly is mounted or to another section of a foldable closure assembly.

The various components of the hinge 16 are preferably made from aluminum by an extrusion process. It may also be envisaged to extrude the components from plastic having the requisite strength and resistance characteristics. As previously mentioned, the male hinge members 22 are integrally formed at the extremities of the panels 12. This form of construction reduces the number of components of the folding closure assembly, therefore the latter is easier to assemble.

The above description of a preferred embodiment of this invention should not be interpreted in any limiting manner as it may be refined and varied in several ways without departing from the spirit of the invention. The scope of the invention is defined in the annexed claims.

The embodiments of the invention in which an exclusive property or privilege is claimed are defined as follows:

1. A hinge construction, comprising:

a female hinge member including an elongated substantially hollow channel which defines in cross-section an inner concave surface extending along an arc of a circle and a fulcrum element in a spaced apart relationship with said concave surface;

a male hinge member received in said elongated channel for pivotal movement about said fulcrum element, said male hinge member including an arcuate member defining in cross-section a convex surface extending along an arc of a circle and being in sliding contact with said concave surface, said male hinge member further including a supporting leg projecting from said arcuate member and engaging said fulcrum element in a supporting contact, said concave and convex surfaces being in an eccentric relationship whereby during a pivotal movement between said hinge members said surfaces contact each other in a sliding relationship over a zone substantially narrower than the area of either one of said surfaces.

2. A hinge construction as defined in claim 1, wherein said supporting leg is located essentially at mid-point between extremities of said arcuate member.

3. A hinge construction as defined in claim 1, wherein said supporting leg has a free rounded end.

4. A hinge construction as defined in claim 1 wherein said concave surface is generally a semi-circular surface.

5. A hinge construction as defined in claim 1, wherein said convex surface is generally a semi-circular surface.

6. A hinge construction as defined in claim 1, comprising means to prevent a relative sliding movement between said hinge members along a longitudinal axis of said channel.

7. A hinge construction as defined in claim 1, wherein said female hinge member includes a socket for receiving a lock to prevent a relative sliding movement between said hinge members along longitudinal axis of said channel.

* * * * *